US010709218B2

(12) United States Patent
Cuss et al.

(10) Patent No.: US 10,709,218 B2
(45) Date of Patent: Jul. 14, 2020

(54) CONTAINER SECTION AND CONTAINER COMPRISING TWO CONTAINER SECTIONS

(71) Applicant: Stitchsmith Limited, London (GB)

(72) Inventors: Laura Camerer Cuss, London (GB); Kirstin Knox, Haslemere (GB)

(73) Assignee: Stitchsmith Limited, London (GB)

( * ) Notice: Subject to any disclaimer, the term of this patent is extended or adjusted under 35 U.S.C. 154(b) by 41 days.

(21) Appl. No.: 15/764,607

(22) PCT Filed: Sep. 29, 2016

(86) PCT No.: PCT/GB2016/053026
§ 371 (c)(1),
(2) Date: Mar. 29, 2018

(87) PCT Pub. No.: WO2017/055845
PCT Pub. Date: Apr. 6, 2017

(65) Prior Publication Data

US 2018/0295956 A1 Oct. 18, 2018

(30) Foreign Application Priority Data

Oct. 2, 2015 (GB) ..... 1517434.5

(51) Int. Cl.
*A45C 1/02* (2006.01)
*A45C 13/08* (2006.01)
*A45C 3/08* (2006.01)

(52) U.S. Cl.
CPC ..... *A45C 1/02* (2013.01); *A45C 3/08* (2013.01); *A45C 13/08* (2013.01)

(58) Field of Classification Search
CPC ..... A45C 1/02; A45C 3/08; A45C 13/08
See application file for complete search history.

(56) References Cited

U.S. PATENT DOCUMENTS 2,216,147 A * 10/1940 Ward ..... A21B 3/133 220/62
2,694,427 A 11/1954 Hovis ..... 50/28
5,518,313 A 5/1996 McAdam ..... 383/4
9,066,566 B2 * 6/2015 Lai ..... A45C 13/001
(Continued)

FOREIGN PATENT DOCUMENTS

CN 2011/072189 3/2011
WO WO-2011127784 A1 * 10/2011 ..... A45C 5/02

OTHER PUBLICATIONS

Search Report from priority application.
International Search Report of this application PCT/GB16/053026.

*Primary Examiner* — Tri M Mai
(74) *Attorney, Agent, or Firm* — MacCord Mason PLLC

(57) ABSTRACT

A container section comprising a convex external surface, a removable resilient cover for covering said external surface and a retention frame for removably retaining said resilient cover on said external surface, in which said resilient cover comprises at least one pair of edges which are displaced from one another when said resilient cover is arranged flat, and which are adjacent to one another when said resilient cover assumes a three dimensional shape corresponding to said external surface, and in which said retention frame comprises a guard portion which is configured such that it overlies said pair of edges when said retention frame retains said resilient cover on said external surface.

9 Claims, 3 Drawing Sheets

(56) References Cited

U.S. PATENT DOCUMENTS

| | | | | |
|---|---|---|---|---|
| 9,743,727 | B2 * | 8/2017 | Lai | B29C 43/14 |
| 2002/0079359 | A1 | 6/2002 | Bradford | 229/199 |
| 2013/0001032 | A1 * | 1/2013 | Kuo | A45C 13/42<br>190/115 |

* cited by examiner

CONTAINER SECTION AND CONTAINER COMPRISING TWO CONTAINER SECTIONS

The present invention relates to a container section, and to a container made up of two such sections, which is for use particularly, but not exclusively, as a decorable clutch bag.

Handbags are fashionable items which are commonly made from luxurious materials, and which are finished with attractive colours or patterns. It is common for women to choose a handbag to complement their overall outfit. As such, if a woman has a variety of different clothing styles and colourings, she may require a number of different handbags to suit.

This is particularly the case with clutch bags, as they are held close to the person, either in the hand or under the arm. Further, clutch bags are common at events at which smart clothing is worn, for example a wedding or garden party, at which the requirement for the accessory clutch bag to suit the outfit is more acute. However, clutch bags are not commonly used as everyday items, as their utility is limited, given their small size and lack of any handle. Therefore, a user may only have a small number of opportunities to use a clutch bag of a given style.

It is known to decorate items such as handbags, for example by adding additional materials or accessories to them. This may allow an existing clutch bag or the like to be reconfigured to suit a different outfit. However, to date no method has been provided for a consumer to quickly and easily completely change the appearance of a handbag. It is known to provide various kinds of structure with interchangeable surface decorations, including bags with removable covers attached by zips or hook and loop fasteners and the like. However, none find particular application with something like a clutch bag, which has convex sides, which would require a material covering to be formed into a three dimensional shape. To form a resilient materials such as a woven fabric or leather into a three dimensional shape it has to be cut into a suitable template shape, and then adjacent edges thereof have to be attached together, for example by stitching. This would require some skill and time for a consumer to perform, and is therefore not an ideal solution. Furthermore, seams formed between adjacent edges may create an undesirable aesthetic finish to a clutch bag.

The present invention is intended to overcome some of the above problems.

Therefore, according to a first aspect of the present invention a container section comprises a convex external surface, a removable resilient cover for covering said external surface and a retention frame for removably retaining said resilient cover on said external surface, in which said resilient cover comprises at least one pair of edges which are displaced from one another when said resilient cover is arranged flat, and which are adjacent to one another when said resilient cover assumes a three dimensional shape corresponding to said external surface, and in which said retention frame comprises a guard portion which is configured such that it overlies said pair of edges when said retention frame retains said resilient cover on said external surface.

Thus, the present invention provides a decorable section of a container, in which a resilient cover is formed into a three dimensional shape to cover the convex external surface thereof, and the retention frame covers the vulnerable and unsightly edges of the resilient cover which extend over the external surface. There is also no need to stitch or otherwise connect the pair of edges together, as they are held in place on the external surface by the retention frame.

It will be appreciated that the convex external surface can be any convex shape, including a sphere, a part of a sphere, a cylinder, a part of a cylinder, a cube, a pyramid and so on. The only requirement is that the resilient cover can be formed into a three dimensional shape which can cover the external surface, and that two edges thereof are adjacent to one another in that configuration. This would include an arrangement in which the two edges are at opposite ends of the resilient cover, and are brought together when the resilient cover forms the three dimensional shape.

However, in a preferred construction the pair of edges can be adjoining edges of the resilient cover, which can be angularly displaced from one another when the resilient cover is arranged flat. A simple example of such a resilient cover would be circular with a triangular wasted section extending to the centre thereof, which resilient cover can then be configured as a cone with the edges of the wasted section adjacent to one another. In such a configuration a single guard portion is all that is required to overlie the pair of edges.

However, it will be appreciated that a more ergonomic container section shape would require the resilient cover to be more complex in shape. Therefore, preferably the resilient cover can comprise a plurality of pairs of adjoining edges which are angularly displaced from one another when the resilient cover is arranged flat, and which can be adjacent to one another when the resilient cover assumes the three dimensional shape. A simple example of such a resilient cover would be cross shaped with a central square section with an extension portion extending from each side thereof, which can then be configured as a cuboid shape with the edges of adjacent extension portions arranged adjacent to one another. In such an arrangement the retention frame can comprise a plurality of guard portions, each one of which can overlie one of the pairs of adjoining edges when the retention frame retains the resilient cover on the external surface.

Preferably the external surface can comprise a panel with a flange portion extending from a periphery thereof, and the resilient cover can comprise a central section which can substantially correspond in size and shape with the panel, and a plurality of extension portions, each of which can extend from the central section and cover a part of the flange portion. This is essentially what is required if the container section were generally cuboid or prism shaped.

The external surface can further comprise a first curved portion which can extend between the panel and the flange portion. In addition, the flange portion can comprise a plurality of sides, and disposed between each adjoining side can be one of a plurality of second curved portions. The first and second curved portions give the external surface a more user friendly and ergonomic shape.

In order to adequately cover such a complex curved-off prism shape the resilient cover can comprise a first set of extension portions, each of which can cover a substantial part of one of the plurality of sides of the flange portion, and a second set of extension portions, each of which can substantially cover one of the plurality of second curved portions. Each of the plurality of pairs of adjoining edges of the resilient cover can comprise an edge of one of the first set of extension portions and an adjoining edge of one of the second set of extension portions.

It will be appreciated that with such a configuration there are two adjacent pairs of adjoining edges at each corner of the external surface. Therefore, in a preferred construction each of the plurality of guard portions can overlie two adjacent pairs of adjoining edges.

In one embodiment of the invention the panel can be rectangular and the flange portion can comprise four sides. The retention frame can then comprise four guard portions, each of which can overlie two adjacent pairs of adjoining edges at one corner of the external surface.

The retention frame can removably retain the resilient cover on the external surface by any known retention mechanism. This could include affixing the retention frame to a part of the external surface itself, or to another structure which forms a part of a container which comprises the container section of the first aspect of the present invention. However, in a preferred construction the flange portion can comprise a first part of a connection means at a periphery thereof, and the retention frame can comprise a base, from which the four guard portions can extend, and which comprises a second part of the connection means adapted to releasably connected to the first part.

The first part of the connection means can extend around the whole of the periphery of the flange portion, and the second part of the connection means can be a friction fit with the first part.

Alternatively, the second part of the connection means can be connected to the first part of the connection means by one or more retention members, such as removable retention clips, or spring loaded ball latches.

In one version of the invention each of the four guard portions can comprise an arm, opposite first and second ends of which can be connected to the base, and the shape of which can substantially correspond to the three dimensional shape formed by the two adjacent pairs of adjoining edges over which the arm lies.

It will be appreciated that the container section can be used as a part of a whole container, and preferably two can be combined to make a container.

Therefore, according to a second aspect of the present invention a container comprises two container sections according to any of claims 1 to 13 below, in which said two container sections are connected together by a hinge and are arrangeable in a closed configuration to define an enclosed interior therein, and in an open configuration to allow access to said interior.

The invention can be performed in various ways, but one embodiment will now be described by way of example and with reference to the accompanying drawings, in which.

Figure 1:
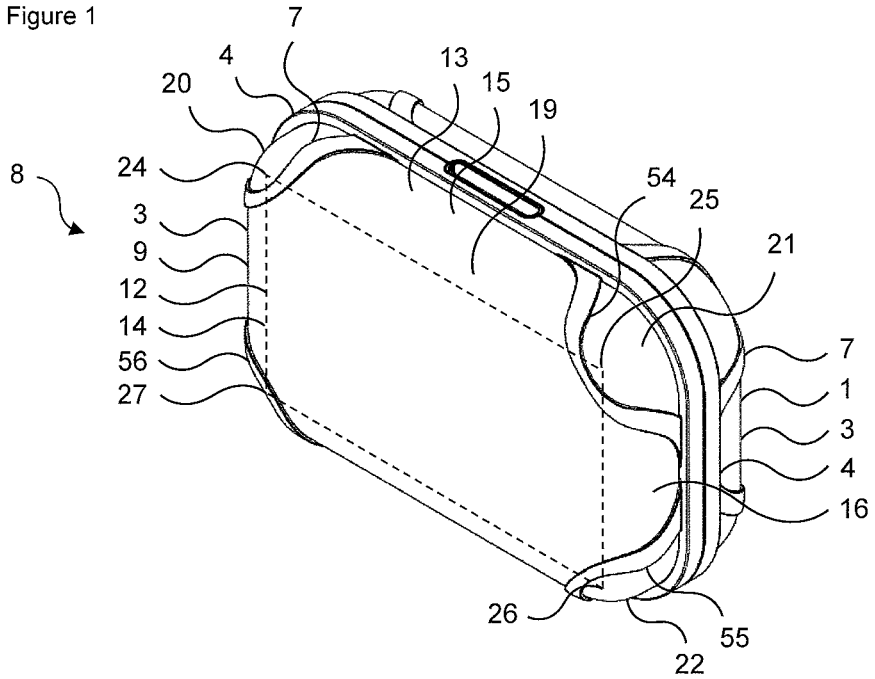
FIG. 1 is a perspective view of a container according to the second aspect of the present invention in a closed configuration, which is made from two container sections according to the first aspect of the present invention.
Figure 2:
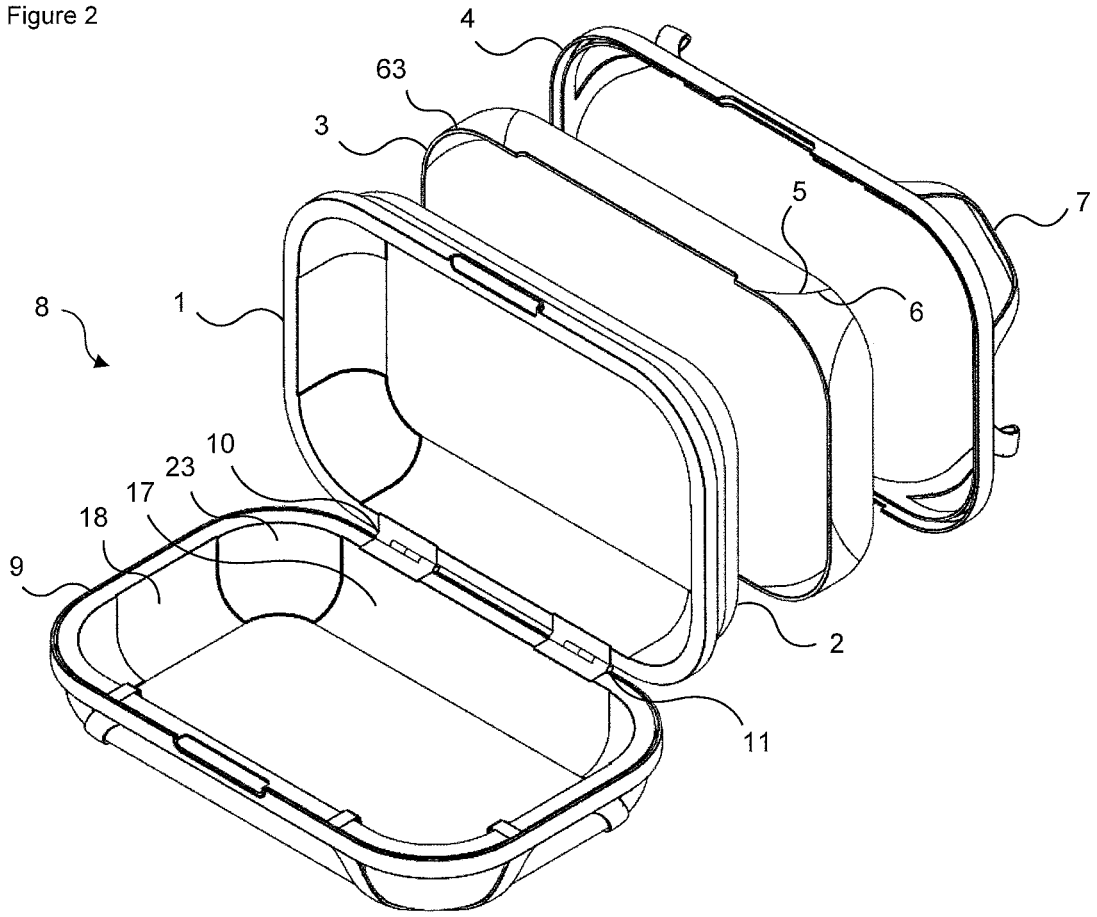
FIG. 2 is an exploded perspective view of the container as shown in FIG. 1 in an open configuration.
Figure 3:
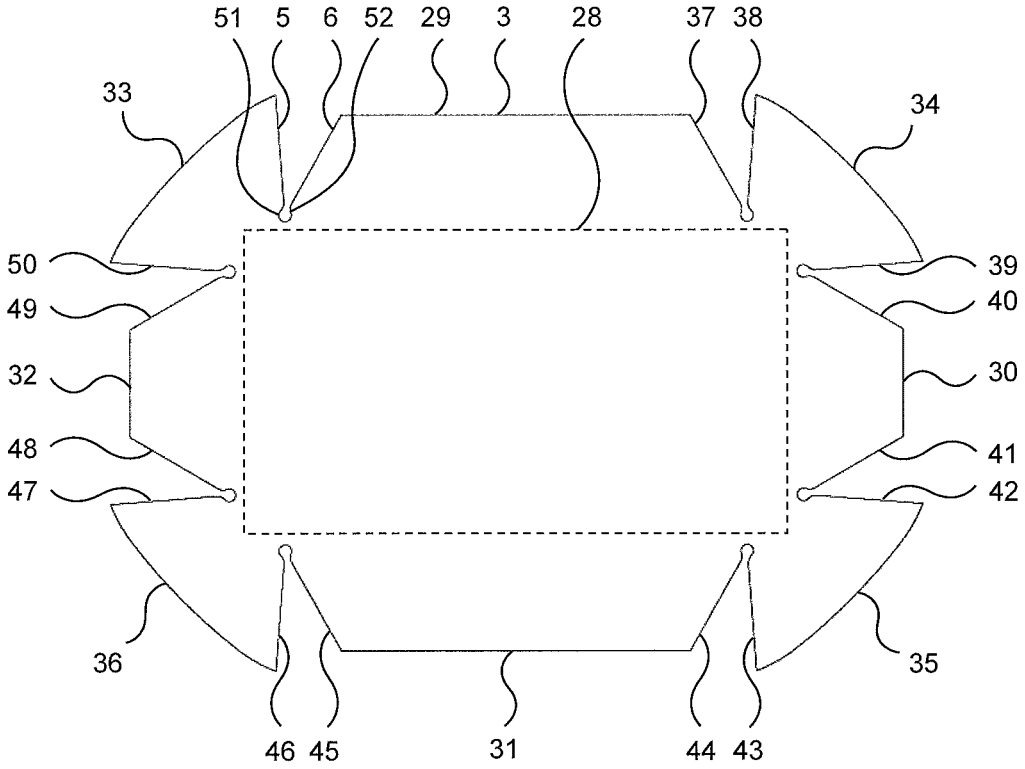
FIG. 3 is a plan view of a resilient cover part of the container shown in FIG. 1.

As shown in FIGS. 1 and 2, a container section 1 comprises a convex external surface 2, a removable resilient cover 3 for covering said external surface 2 and a retention frame 4 for removably retaining said resilient cover 3 on said external surface 2. The resilient cover 3 comprises at least one pair of edges 5 and 6 which are displaced from one another when the resilient cover 3 is arranged flat, as shown in FIG. 3, and which are adjacent to one another when the resilient cover 3 assumes a three dimensional shape corresponding to the external surface 2, as shown in FIG. 2, and in which the retention frame 4 comprises a guard portion 7 which is configured such that it overlies the pair of edges 5 and 6 when the retention frame 4 retains the resilient cover 3 on the external surface 2.

The container section 1 forms one half of a clutch bag 8, which comprises first container section 1, and second container section 9 which is substantially the same, and the same reference numerals are therefore used in each case. (For ease of explanation the following description refers interchangeably to the two container sections 1 and 9, as some features are better seen on one that the other, but as the two container sections 1 and 9 are substantially the same this description can be understood to refer to a single kind of construction.) The two container sections 1 and 9 are connected together by hinges 10 and 11, and as is clear from FIGS. 1 and 2, they can be arranged in a closed configuration and in an open configuration, in a conventional way for a clutch bag.

The shape of the external surfaces 2 of the container sections 1 and 9 are most easily understood by referring to the second container section 9 as shown in FIG. 1. The external surface of the container section 9 is not visible because it is covered by the resilient cover 3, however, the underlying shape can be appreciated. The external surface 2 is basically a rectangular shape with rounded edges and corners. It comprises a rectangular panel, as indicated by hashed box 12, with a flange portion 13 extending normally from a periphery 14 thereof. As the panel 12 is rectangular, the flange portion 13 comprises four sides, two of which 15 and 16 are visible in FIG. 1, and the undersides 17 and 18 of the other two of which are visible in FIG. 2. A first curved portion 19 extends between the panel 12 and the flange portion 13, around the whole periphery 14 of the panel 12. Further, disposed between each adjoining side 15, 16 of the flange portion 13 are four second curved portions, three of which 20, 21 and 22 are visible in FIG. 1, and the underside 23 of the other one of which is visible in FIG. 2. The first curved portion 19 and the second curved portions 20, 21 and 22 merge together at the corners 24, 25, 26 and 27 of the external surface 2.

As is clear from the Figures, the first and second curved portions 19, 20, 21 and 22 give the external surface 2 a more user friendly and ergonomic shape.

Referring to FIG. 3, this shows the resilient cover 3 laid out flat, with its outward facing side shown (i.e. from the same side as the resilient cover 3 visible on the second container section 9 as shown in FIG. 1, but from the opposite side to resilient cover 3 shown in exploded isolation in FIG. 2). The resilient cover 3 comprises a piece of flexible material which is for decorating the external surface 2. It is shown in FIG. 3 as blank, but it will be appreciated that it could carry any surface decoration or colour, or it could be constructed from a material with a desired finish, for example leather.

The resilient cover 3 comprises a central rectangular section, as indicated by hashed box 28, which corresponds in size and shape with panel 12, and a first set of extension portions 29, 30, 31 and 32 which extend from the central section 28. Each of the first set of extension portions 29-32 covers a substantial part of side 15, 16 (17 and 18) respectively of the flange portion 13 when the retention frame 4 retains the resilient cover 3 on the external surface 2, as shown in FIG. 1. The resilient cover 3 further comprises a second set of extension portions 33, 34, 35 and 36, each of which covers one of the second curved portions 20, 21 and 22 when the retention frame 4 retains the resilient cover 3 on the external surface 2, as shown in FIG. 1.

As a result of this shape, the resilient cover 3 comprises eight pairs of edges, 5 and 6, 37 and 38, 39 and 40, 41 and 42, 43 and 44, 45 and 46, 47 and 48 and 49 and 50. As is clear from FIG. 3, the edges 5, 6, 37-50 in each respective pair of edges are edges of the outline shape of the resilient cover 3 which are adjacent to one another, and in the case of each pair, they are angularly displaced from one another when the resilient cover 3 is arranged flat. The edges 5, 6, 37-50 in each respective pair comprise one edge of one of the first set of extension portions 29-32 and an adjoining edge of one of the second set of extension portions 33-36.

Referring to edges 5 and 6, at the corner 51 where they meet, there is provided a small substantially annular wasted section 52. This is provided to assist the resilient cover 3 in achieving the three dimensional shape as shown in FIG. 1 without any ridge being formed where the material is compressed at the corner 51. Similar annular wasted sections are provided at the corners where the other pairs of edges 37-50 meet.

Figure 4:
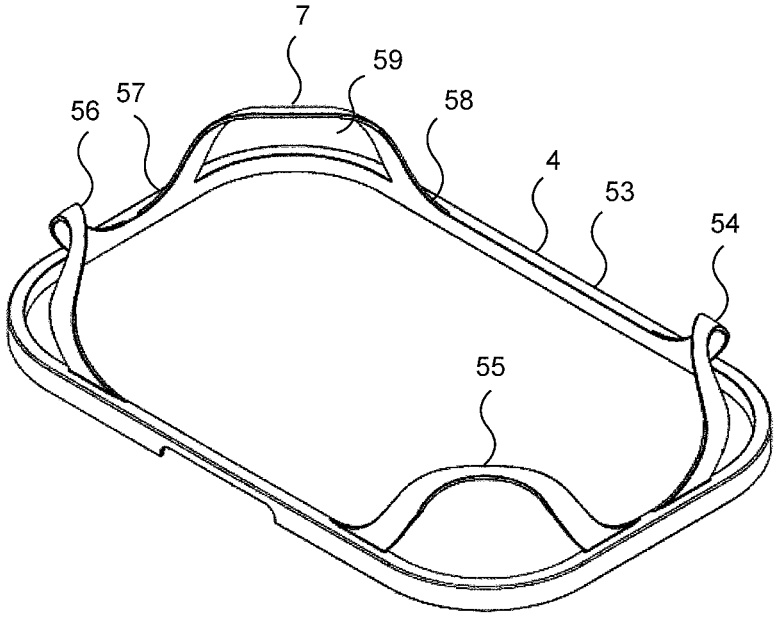
FIG. 4 is a perspective view of a retention frame part of the container as shown in FIG. 1.

Referring to FIG. 4, this shows the retention frame 4 in isolation (from the same side as the retention frame 4 visible on the second container section 9 as shown in FIG. 1, but from the opposite side to retention frame 4 shown in exploded isolation in FIG. 2). The retention frame 4 comprises a rectangular base 53, and four guard portions 7, 54, 55 and 56. Each of these comprises a curved arm, which extends both upwardly and inwardly of the base 53. Referring to arm 7, it comprises opposite first and second ends 57 and 58 which are connected to the base 53, so there is defined an opening 59. The arm 7 is shaped such that it substantially corresponds in shape to the three dimensional shape formed by adjacent pairs of edges 49 and 50 and 5 and 6 of the resilient cover 3 at corner 24, over which arm 7 lies when the retention frame 4 retains the resilient cover 3 on the external surface 2, as shown in FIG. 1. Guard portions 54, 55 and 56 have the same structure, and when the retention frame 4 retains the resilient cover 3 on the external surface 2, guard portion 54 overlies adjacent pairs of edges 37 and 38 and 39 and 40 at corner 25, guard portion 55 overlies adjacent pairs of edges 41 and 42 and 43 and 44 at corner 26, and guard portion 56 overlies adjacent pairs of edges 45 and 46 and 47 and 48 at corner 27.

Figure 5:
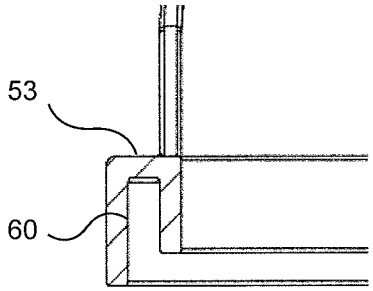
FIG. 5 is a cross-sectional view of a section of a retention frame part of the container shown in FIG. 1.
Figure 6:
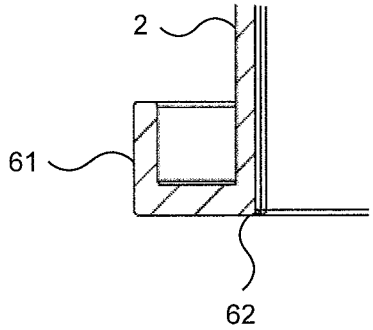
FIG. 6 is a cross-sectional view of a section of an external surface part of the container shown in FIG. 1.
Figure 7:
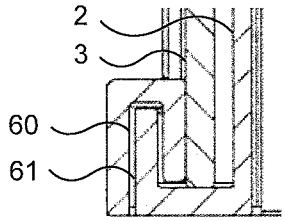
FIG. 7 is a cross-sectional view of a section of the container shown in FIG. 1.

Referring to FIG. 5, it can be seen that the base 53 of the retention frame 4 comprises a socket 60. This socket 60 extends around the whole of the base 53. Referring to FIG. 6, it can be seen that the external surface 2 comprises a lip 61, and again this extends around the whole of a periphery 62 of the external surface 2. Referring to FIG. 7, this shows how when the resilient cover 3 is applied to the external surface 2, the socket 60 can be placed onto the lip 61, and is affixed thereto by a releasable friction fit.

The container section 1 of the first aspect of the invention operates as follows. The user places the resilient cover 3 on the external surface 2, with the central section 28 aligned with the panel 12, and folds the eight extension portions 29-36 down against the sides 15, 16 and the second curved portions 20-22 accordingly. This makes the resilient cover 3 assume a three dimensional shape corresponding to the external surface 2, in which each of the pairs of edges 5, 6 and 37-50 are moved into a position in which they are adjacent to one another. As is clear from FIG. 2, in this position the other eight edges of the resilient cover 3 collectively assume a rectangular shape with curved corners 63, which corresponds to the shape of the lip 61, and those edges are disposed within the lip 61, as shown in FIG. 7.

The retention frame 4 is then placed over the resilient cover 3, and the socket 60 is fitted over the lip 61, to releasably friction fit the retention frame 4 in place on the external surface 2, and retain the resilient cover 3 thereon, as shown in FIG. 1.

The guard portion 7 overlies the adjacent pairs of edges 49 and 50 and 5 and 6 at corner 24, guard portion 54 overlies adjacent pairs of edges 37 and 38 and 39 and 40 at corner 25, guard portion 55 overlies adjacent pairs of edges 41 and 42 and 43 and 44 at corner 26, and guard portion 56 overlies adjacent pairs of edges 45 and 46 and 47 and 48 at corner 27. Therefore, all the edges 5, 6, 37-50 of the resilient cover 3 are covered over and protected. As such, the portions of the resilient cover 3 which are visible are continuous, and not interrupted by any gaps.

It will be appreciated that the resilient cover 3 can be one of a plurality of identically shaped resilient covers 3 which have different surface colours or patterns, or which are made from different decorative materials. Therefore, in order to change the appearance of the container section 1 the user can remove the retention frame 4, by forcing the socket 60 away from the lip 61 against the retention force of the friction fit, remove the resilient cover 3, and replace it with another one, which can be fitted in the same manner described above.

This system allows a user to easily create their own resilient covers 3 out of materials which would suit a desired outfit. It is simply necessary for them to cut a suitable template of material in the shape as illustrated in FIG. 3. Such a template of material can be used on its own, but it is also possible to provide backings in the same shape as the resilient cover 3, to which desired pieces of material can be adhered. This results in a more sturdy and long lasting composite resilient cover. This system also allows for the sale of manufactured material templates, and/or backings to which material can be adhered, either individually, or in packs.

It will also be appreciated that the retention frame 4 can also be one or a plurality of identically shaped retention frames 4 which have different surface colours, patterns or finishes. Therefore, in order to change the appearance of the container section 1 even more, the user can remove the retention frame 4 and replace it with another of a different appearance. This allows for an even greater degree of flexibility in customisation of the appearance of the container section 1. Further, this system also allows for the sale of replacement retention frames, either individually, or in packs.

The second aspect of the present invention is a container comprising two container sections according to the first aspect of the present invention. It will be appreciated how clutch bag 8 shown in FIGS. 1 and 2 comprises such a container, and it therefore provides full support for the second aspect of the present invention.

The container section 1 and the second container section 9 are the same, so it is possible for a user to change the resilient cover 3 and/or the retention frame 4 in both cases as outlined above. This allows the user to use the same kind of resilient cover 3 and retention frame 4 on both sides, in order to create a single pattern, colour or material bag, but it also allows them to have a clutch bag with differently decorated sides, if desired.

The two container sections 1 and 9 are connected together by hinges 10 and 11, so they can be arranged in a closed configuration as shown in FIG. 1, and in an open configuration as shown in FIG. 2. A known mechanism, for example magnets (not shown) is provided to close the clutch bag 8 in the closed configuration.

The container section 1 and clutch bag 8 can be altered without departing from the scope of claim 1. For example, in alternative embodiments (not shown) the external surface is another shape, including a sphere, a part of a sphere, a cylinder, a part of a cylinder, a cube, a pyramid, and any kind of prism shape. With these embodiments the resilient cover is shaped accordingly.

In another alternative embodiment (not shown) the external surface and/or the resilient cover is provided with a high friction or adhesive surface, to assist in the placement or securing of the resilient cover on the external surface.

In other alternative embodiments (not shown) instead of the socket and lip arrangement of first connection means and second connection means, the base of the retention frame simply fits into a trough provided at the periphery of the external surface of the container section, and it is retained therein by one or more retention members, such as removable retention clips, or spring loaded ball latches.

Therefore, the present invention provides a decorable convex container section, or a container comprising two such container sections, in which any joins in the overlying material are covered. This provides protection from damage, and also achieves a new aesthetic finish. The invention also provides a clutch bag with readily interchangeable surface coverings, which allows it to be used repeatedly with different outfits.

The invention claimed is:

1. A container section comprising a convex external surface, a removable resilient cover for covering said external surface and a retention frame for removably retaining said resilient cover on said external surface, in which said resilient cover comprises a plurality of pairs of adjoining edges which are angularly displaced from one another when said resilient cover is arranged flat, and which are adjacent to one another when said resilient cover assumes a three dimensional shape corresponding to said external surface, in which said retention frame comprises a plurality of guard portions, each one of which overlies one of said pairs of edges when said retention frame retains said resilient cover on said external surface, in which said external surface comprises a panel with a flange portion extending from a periphery thereof, in which said flange portion comprises a plurality of sides, in which disposed between each adjoining side is one of a plurality of first curved portions, in which said resilient cover comprises a central section which substantially corresponds in size and shape with said panel, a first set of extension portions, each of which extends from said central section and covers a substantial part of one of said plurality of sides of said flange portion, and a second set of extension portions, each of which extends from said central section and substantially covers one of said plurality of first curved portions, and in which each of said plurality of pairs of adjoining edges of said resilient cover comprises an edge of one of said first set of extension portions and an adjoining edge of one of said second set of extension portions.

2. A container section as claimed in claim 1 in which said external surface comprises a second curved portion which extends between said panel and said flange portion.

3. A container section as claimed in claim 2 in which each of said plurality of guard portions overlies two adjacent pairs of adjoining edges.

4. A container section as claimed in claim 3 in which said panel is rectangular and said flange portion comprises four sides, in which said retention frame comprises four guard portions, each of which overlies two adjacent pairs of adjoining edges at one corner of said external surface.

5. A container section as claimed in claim 4 in which said flange portion comprises a first part of a connection means at a periphery thereof, and in which said retention frame comprises a base, from which said four guard portions extend, and which comprise a second part of said connection means adapted to releasably connected to said first part.

6. A container section as claimed in claim 5 in which said first part of said connection means extends around the whole of said periphery of said flange portion, in which said second part of said connection means is a friction fit with said first part.

7. A container section as claimed in claim 5 in which said second part of said connection means is connected to said first part of said connection means by one or more retention members.

8. A container section as claimed in claim 5 in which each of said four guard portions comprises an arm, opposite first and second ends of which are connected to said base, and the shape of which substantially corresponds to the three dimensional shape formed by the two adjacent pairs of adjoining edges over which said arm lies.

9. A container comprising two container sections according to claim 1, in which said two container sections are connected together by a hinge and are arrangeable in a closed configuration to define an enclosed interior therein, and in an open configuration to allow access to said interior.

* * * * *